US007992579B2

(12) United States Patent
Longoria et al.

(10) Patent No.: US 7,992,579 B2
(45) Date of Patent: Aug. 9, 2011

(54) HAIR CLIP WITH LATCH MECHANISM

(75) Inventors: Jose Longoria, Miami, FL (US); Melvin R. Kennedy, Lantana, FL (US); Stephen Chininis, Norcross, GA (US)

(73) Assignee: Goody Products Inc., Atlanta, GA (US)

( * ) Notice: Subject to any disclaimer, the term of this patent is extended or adjusted under 35 U.S.C. 154(b) by 679 days.

(21) Appl. No.: 11/647,925

(22) Filed: Dec. 29, 2006

(65) Prior Publication Data

US 2008/0156341 A1 Jul. 3, 2008

(51) Int. Cl.
*A45D 8/22* (2006.01)

(52) U.S. Cl. ..... 132/279

(58) Field of Classification Search ..... 132/273, 132/276, 277, 279; 24/506–508, 510
See application file for complete search history.

(56) References Cited

U.S. PATENT DOCUMENTS

| | | | | |
|---|---|---|---|---|
| 5,618,210 | A * | 4/1997 | Grant | 439/822 |
| 5,791,024 | A | 8/1998 | Jovanovich | 24/502 |
| 6,082,371 | A | 7/2000 | Bader-Saltzman et al. | 132/276 |
| D485,644 | S | 1/2004 | Winn et al. | D28/43 |
| 7,149,419 | B2 | 12/2006 | Akada | 396/55 |
| 2004/0065341 | A1 | 4/2004 | La Fauci | 132/277 |
| 2004/0149306 | A1 | 8/2004 | Rogers | 132/277 |
| 2004/0177861 | A1 | 9/2004 | Rogers et al. | |
| 2004/0182411 | A1 * | 9/2004 | Rogers et al. | 132/277 |
| 2004/0226574 | A1 | 11/2004 | Winn et al. | 132/277 |
| 2004/0231692 | A1 | 11/2004 | Shyu | |

OTHER PUBLICATIONS

International Search Report and Written Opinion; Jun. 10, 2008; 9 pgs.
Examination Report issued in related Great Britain Application No. 0911231.9 dated Jan. 6, 2011.

* cited by examiner

*Primary Examiner* — Rachel R Steitz
(74) *Attorney, Agent, or Firm* — Lempia Summerfield Katz LLC

(57) ABSTRACT

A hair retaining clip including a first clip member, a second clip member, a hinge, and a latch mechanism is disclosed. The first and second clip members may each include a handle portion and a claw portion. The hinge is disposed between and pivotally connects the first and second clip members. The latch mechanism selectively retains the first and second clip members in a generally open configuration.

15 Claims, 8 Drawing Sheets

HAIR CLIP WITH LATCH MECHANISM

TECHNICAL FIELD

The present disclosure relates generally to a device for retaining strands of hair and, more particularly, to a retaining clip commonly known as a "claw clip."

BACKGROUND OF THE DISCLOSURE

Retaining clips and, more specifically, claw clips for holding or retaining strands of hair during hair care or hair styling are widely used and have been around for many years.

One such example of a retaining clip is shown in United States Published Patent Application No. 2004/0065341. This application discloses a jaw hair clip for firmly holding hair. The jaw hair clip includes a first jaw portion pivotally attached to a second jaw portion via a hinge. The first and second jaw portions are biased together by a spring disposed on the hinge. Rubber or soft plastic beading is formed on at least one of the first or second jaw portions to soften the pressure applied to the hair, while minimizing slippage.

Another example of a retaining clip is shown in United States Published Patent Application No. 2004/0149306. This application discloses a hair holding device with an elastic closure operation. The hair holding device includes first and second body members pivotally connected via a hinge Each of the body members includes a hair gripping portion for engaging strands of hair. The first and second body members are biased together with a spring disposed at the hinge. The first and second body member include at least one elastomeric member for biasing the first and second body members together once the hair holding device is in a closed configuration.

U.S. patent application Ser. No. 11/302,647, filed on Dec. 14, 2005, entitled, "Hair Retaining Clip with Elastic Biasing Member," the entirety of which is hereby incorporated by reference herein, discloses a hair retaining clip that includes an elastic member that biases first and second claw portions together to a normal closed configuration.

These and similar retaining clips, however, lack an ability to be latched in an open configuration.

SUMMARY OF THE DISCLOSURE

In accordance with one aspect of the disclosure, a reliable and durable hair retaining clip for retaining a bundle of hair is disclosed. The retaining clip includes first and second clip members each having a handle portion and a claw portion. A hinge is disposed and pivotally connects the first and second clip members such that the clip members may be moved between an open configuration and a closed configuration. A latch mechanism is provided that may be engaged and disengaged, and when engaged, retains the first and second clip members in the open configuration.

In accordance to another aspect of the disclosure, a hair clip for retaining a bundle of hair includes a first clip member, a second clip member, a hinge, and a latch mechanism for selectively retaining the first and second clip members in the open configuration. Each of the first and second clip members includes a first end having a handle portion and a second end having a claw portion. The hinge is disposed between and pivotally connects the first and second clip members. The latch mechanism may include a pawl and a notch that engages the pawl to retain the first and second clip members in the open configuration.

BRIEF DESCRIPTION OF THE DRAWINGS

Objects, features, and advantages of the present device will become apparent upon reading the following description in conjunction with the drawing figures, in which.

Figure 1:
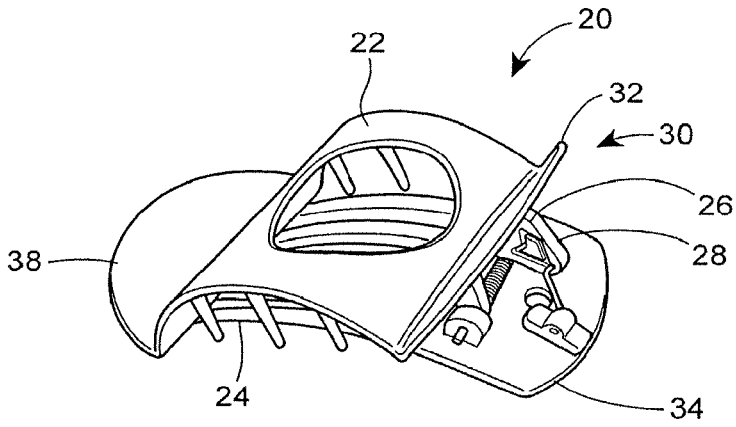
FIG. 1 is perspective diagrammatic view of a hair retaining clip in a generally closed configuration, viewed from above, according to one embodiment of the disclosure.

While the methods and devices described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure and the claims.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Referring now to the drawings and with specific reference initially to FIGS. 1 through 3 and FIGS. 3A and 3B, a hair retaining clip constructed in accordance with the teachings of the disclosure is generally depicted by reference numeral 20. As shown therein, the hair retaining clip 20 in this exemplary embodiment includes a first half or first clip member 22, a second half or second clip member 24, a hinge 26, and a push-push latch mechanism 28 (shown in detail in FIG. 3A). The first and second clip members 22, 24 are pivotally connected via the hinge 26 near a handle 30 of the hair retaining clip 20. The handle 30 includes a first handle portion 32 that is part of the first clip member 22, and a second handle portion 34 that is part of the second clip member 24. A claw or retaining portion 36 is disposed opposite the handle 30 on the hair retaining clip 20. The claw 36 includes a first claw portion 38 that is part of the first clip member 22 and a second claw portion 40 that is part of the second clip member 24.

Figure 3:
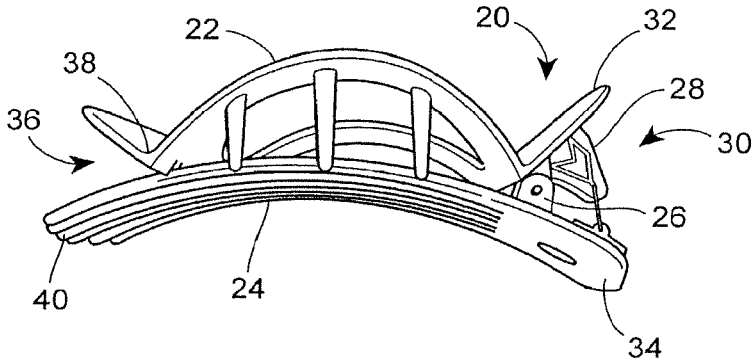
FIG. 3 is a perspective diagrammatic view of the hair retaining clip of FIG. 1, similar to that of FIG. 2, showing the hair retaining clip in a generally closed configuration.

A coil spring 42 may be mounted to the hair retaining clip to provide a bias torque at the hinge 26 that tends to urge the claw 36 toward a closed configuration, as depicted in FIGS. 1 and 3.

Figure 2:
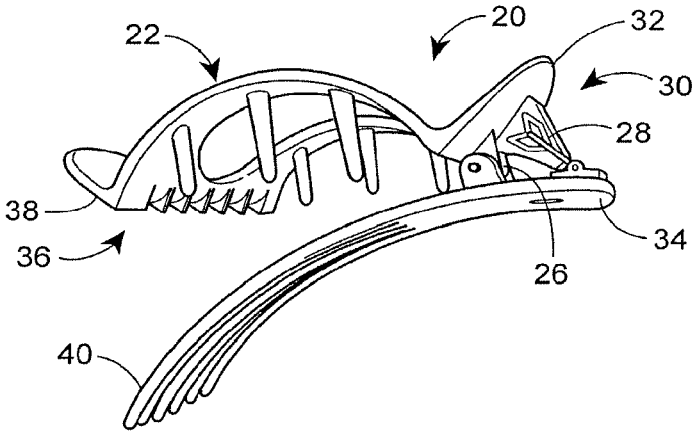
FIG. 2 is a perspective diagrammatic view of the hair retaining clip of FIG. 1 in a generally open configuration, viewed from a side.

The hair retaining clip 20 may be opened or placed in an open configuration, as seen in FIG. 2, by manually squeezing the first and second handle portions 32, 34 towards each other, thereby moving the first and second claw portions 38, 40 of the claw 36 apart. The push-push latch mechanism 28 is thereby placed in a latched configuration, holding the first and second claw portions 38, 40 of the claw 36 apart, and holding the hair retaining clip 20 in a generally open configuration, as depicted in FIG. 2. When the first and second handle portions 32, 34 are again squeezed together, the push-push mechanism 28 releases and the hair retaining clip 20 is placed in a generally closed configuration, as depicted in FIGS. 1 and 3.

Figure 3A:
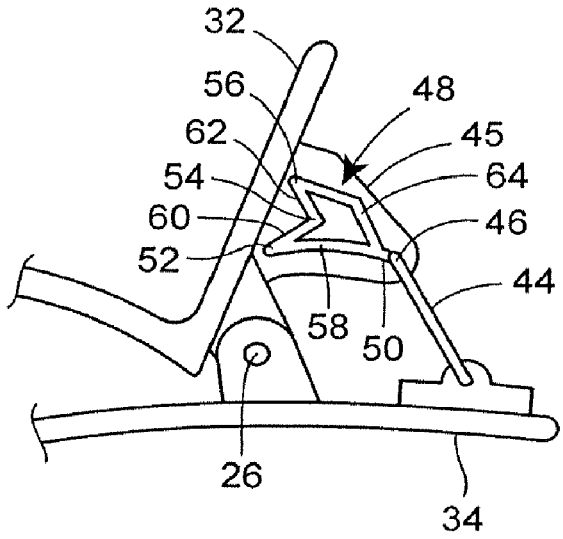
FIG. 3A is an enlarged side view of a latch mechanism of the hair retaining clip of FIG. 1.
Figure 3B:
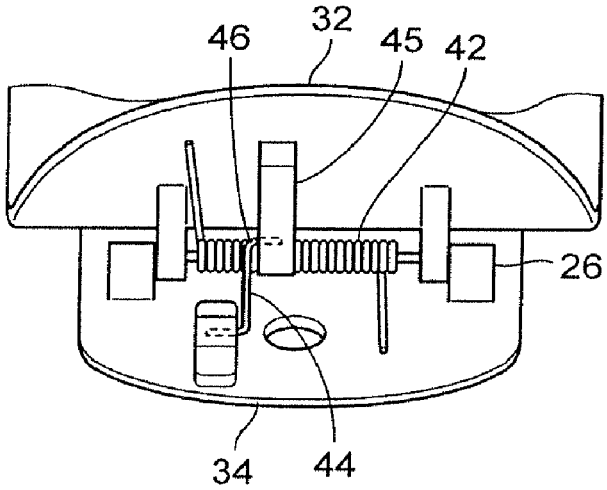
FIG. 3B is an enlarged end view of the latch mechanism of FIG. 3A.

As shown in FIGS. 3A and 3B, the push-push latch mechanism 28 may comprise a pivot pin 44 that is pivotally attached to the second handle portion 34. The pivot pin 44 may be "Z" shaped (see FIG. 3B), and may include an end portion 46 that extends into a slot track 48 formed in a slot track carrier 45 that is attached to the first handle portion 32. The slot track carrier 45 may be made from a polymer material or any other suitable material. The pivot pin 44 may be made from spring steel or any other suitable material and may be oriented and formed such that the end portion 46 is biased toward the slot track 48 and does not emerge from the slot track 48 during use of the hair retaining clip 20. The slot track 48 has a first vertex 50, a second vertex 52, a third vertex 54, and a fourth vertex 56. The first vertex 50 is connected to the second vertex 52 by a first slot portion 58. The second vertex 52 is connected to the third vertex 54 by a second slot portion 60. The third vertex 54 is connected to the fourth vertex 56 by a third slot portion 62. The fourth vertex 56 is connected to the first vertex 50 by a fourth slot portion 64.

The push-push latch mechanism 28 operates as follows. When the hair retaining clip 20 is in the generally closed configuration, the end portion 46 of the pivot pin 44 is disposed in the first vertex 50 of the slot track 48. As the handle portions 32 and 34 are squeezed together by a user, the end portion 46 of the pivot pin 44 moves along the first slot portion 58 to the second vertex 52. Next, as pressure is released from the handle portions 32 and 34 by the user, the spring 42 urges the handle portions 32 and 34 apart from one another, and the end portion 46 of the pivot pin 44 moves along the second slot portion 60 to the third vertex 54, and the hair retaining clip 20 is thereby maintained in the latched configuration, holding the first and second claw portions 38, 40 of the claw 36 apart, and holding the hair retaining clip 20 in a generally open configuration, as depicted in FIG. 2.

When the user wishes to close the hair retaining clip 20, the user may simply squeeze the handle portions 32 and 34 together once again, and the end portion 46 of the pivot pin 44 moves along the third slot portion 62 to the fourth vertex 56. Next, as pressure is released from the handle portions 32 and 34 by the user, the spring 42 urges the handle portions 32 and 34 apart from one another, and the end portion 46 of the pivot pin 44 moves along the fourth slot portion 64 to the first vertex 50, and the hair retaining clip 20 is thereby returned to the generally closed configuration. Thus, in moving from the generally closed configuration to the latched/open configuration and back to the generally closed configuration, the end portion 46 of the pivot pin 44 moves around the slot track 48 in a clockwise direction, as oriented in FIG. 3A. The fourth slot portion 64 may be curved to ensure smooth operation as the end portion 46 of the pivot pin 44 returns to the first vertex 50 when the hair retaining clip 20 is being closed.

To ensure consistent and uniform operation of the push-push latch mechanism 28, the depth of the slot track 48 may be tailored to ensure that the end portion 46 of the pivot pin 44 does not reverse direction (i.e., move in a counter-clockwise direction around the slot track, as oriented in FIG. 3A). For example, the depth of the first slot portion 58 may decrease from the first vertex 50 to the vicinity of the second vertex 52, and then may "step down" to a greater depth at the second vertex 52. Similarly, the depth of the second slot portion 60 may decrease from the second vertex 52 to the vicinity of the third vertex 54, and then may "step down" to a greater depth at the third vertex 54. Similarly, the depth of the third slot portion 62 may decrease from the third vertex 54 to the vicinity of the fourth vertex 56, and then may "step down" to a greater depth at the fourth vertex 56. Finally, the depth of the fourth slot portion 64 may decrease from the fourth vertex 56 to the vicinity of the first vertex 50, and then may once again "step down" to a greater depth at the first vertex 50.

The clip 20, as disclosed herein, may be used to retain strands of hair such as, for example, in a pony tail, but may be used in other fashions and manners that may or may not include the retention of hair.

The clip 20 and, more specifically, the first clip member 22, the second clip member 24, and at least portions of the hinge 26, may be constructed from a variety of materials, including, but not limited to wood, plastic, metal, and/or composites. Preferably, however, the above components are constructed with an injection molding process using plastic materials such as ABS, polypropelene, high impact polystyrene, or the like.

With reference to FIGS. 4 through 8, a hair retaining clip, according to another embodiment of the disclosure, is generally indicated at 120. The hair retaining clip 120 in this exemplary embodiment includes a first half or first clip member 122, a second half or second clip member 124, a hinge 126, and a pawl and notch latch mechanism 128. The first and second clip members 122, 124 are pivotally connected via the hinge 126 near a handle 130 of the hair retaining clip 120. The handle 130 includes a first handle portion 132 that is part of the first clip member 122, and a second handle portion 134 that is part of the second clip member 124. A claw or retaining portion 136 is disposed opposite the handle 130 on the hair retaining clip 120. The claw 136 includes a first claw portion 136*a* that is part of the first clip member 122 and a second claw portion 136*b* that is part of the second clip member 124.

Figure 4:
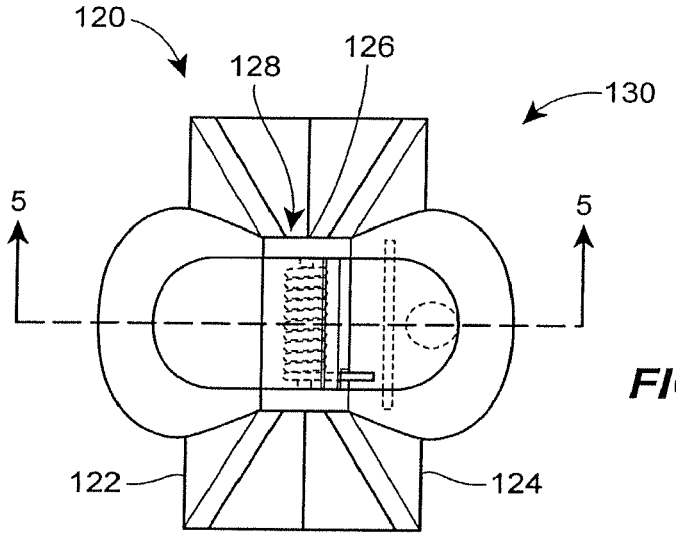
FIG. 4 is a plan diagrammatic view of another embodiment of a hair retaining clip, in a generally closed configuration.
Figure 5:
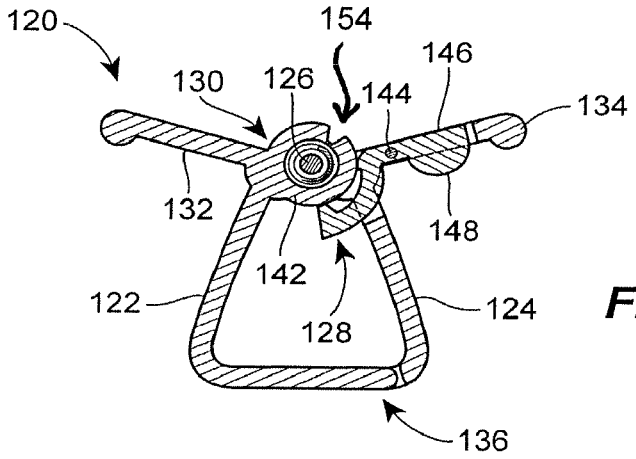
FIG. 5 is a cross-sectional diagrammatic view, taken along lines 5-5 of FIG. 4, of the hair retaining clip of FIG. 4 in a generally closed configuration.
Figure 7:
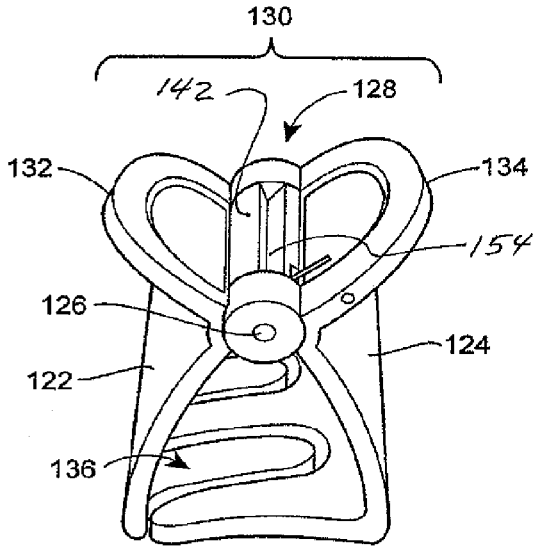
FIG. 7 is a perspective diagrammatic view of the hair retaining clip of FIG. 4.
Figure 8:
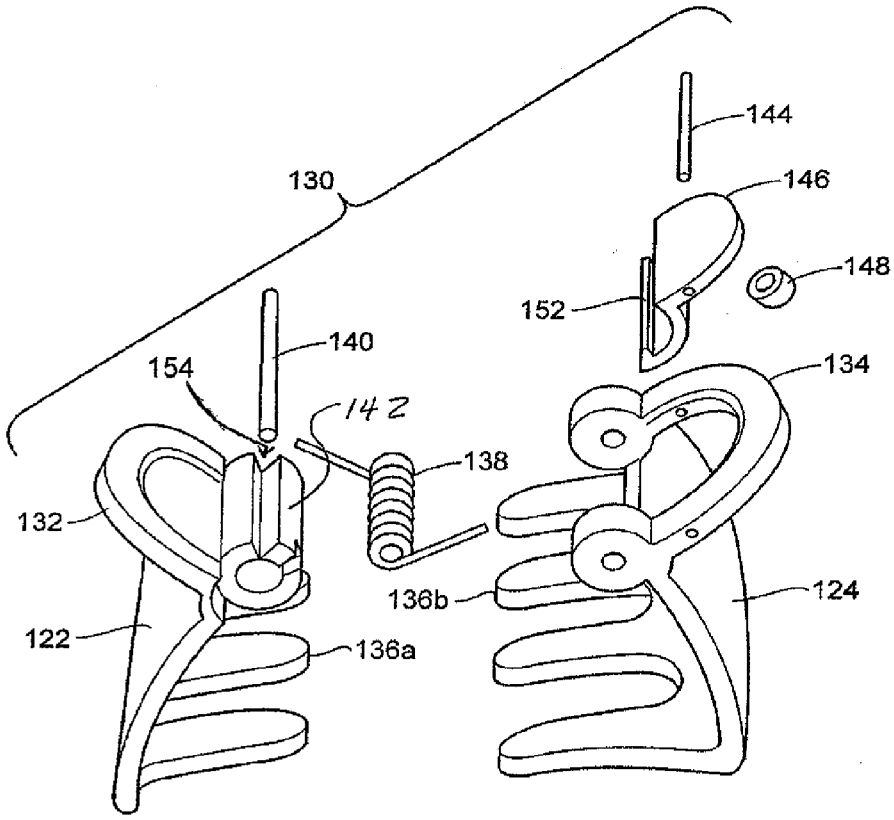
FIG. 8 is an exploded perspective diagrammatic view of the components of the hair retaining clip of FIG. 4.

A coil spring 138 may be mounted to the hair retaining clip to provide a bias torque at the hinge 126 that tends to urge the claw 136 toward a closed configuration, as depicted in FIGS. 4, 5, and 7. The coil spring 138 may be mounted such that it surrounds a primary hinge pin 140 and is substantially surrounded by a hub 142.

The pawl and notch latch mechanism 128 may include a pawl hinge pin 144 that pivotally mounts a pawl lever portion 146 to the second handle portion 134. A button 148 may be mounted to the pawl lever portion 146 (or integrally molded as part of the pawl lever portion 146) to facilitate a tactile identification of the pawl lever portion 146 by a user. Thus, when the button 148 is pressed by the user, the pawl lever portion 146 may be rotated in a counter-clockwise direction with respect to the second handle portion 134, as oriented in FIGS. 5-7. A sculpted ridge 150 may be provided on the second handle portion 134 to provide a tactile identifying cue to the user for avoiding contact with the pawl lever portion 146. By pressing the button 148, while squeezing the first handle portion 132 and the second handle portion 134 toward one another, the user may bring a pawl 152 out of contact with the hub 142, against the force applied to the pawl lever portion by the coil spring 138. This may be done, for example, when the user does not desire the pawl and notch latch mechanism 128 to engage (i.e., when the user desires to close the hair retaining clip 120 or to avoid having the hair retaining clip 120 latched in an open configuration).

Figure 6:
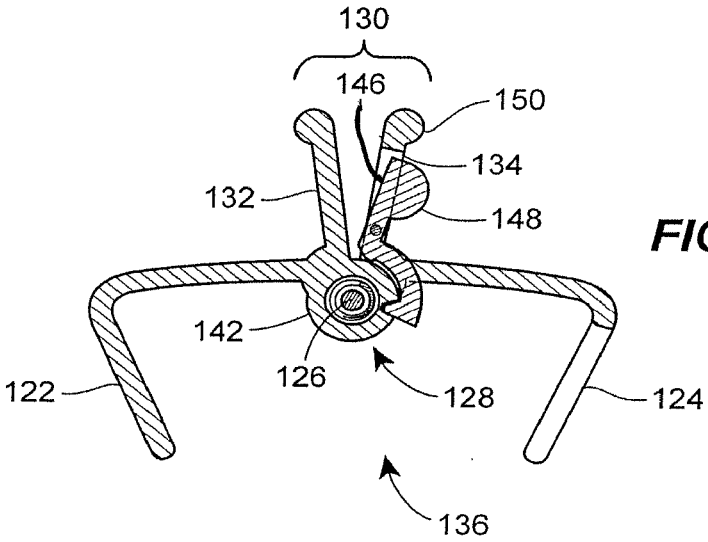
FIG. 6 is a cross-sectional diagrammatic view of the hair retaining clip of FIG. 4, in a generally open configuration.

By using the sculpted ridge 150 on the second handle portion 134 and squeezing the first handle portion 132 and the second handle portion 134 toward one another, without contacting the button 148 or the pawl lever portion 146, the user may place the hair retaining clip 120 in an open and latched configuration, as shown in FIG. 6. When this procedure is followed, the pawl 152 may slide along the outer surface of the hub 142 until the pawl 152 engages the notch 154, due to the torque applied to the pawl lever portion 146 by the coil spring 138. The coil spring 138 provides two functions. First, the coil spring 138 urges the handle portions 132 and 134 away from each other, thereby tending to urge the hair retaining clip 120 toward a closed configuration. Second, the coil spring 138 urges the pawl 152 toward the center of the hub 142, thereby ensuring that the pawl 152 will securely engage the notch 154 on the hub 142.

Thus, the hair retaining clip 120 may be opened or placed in an open configuration, as seen in FIG. 6, by manually squeezing the first and second handle portions 132, 134 towards each other, thereby moving the first and second claw portions 136*a* and 136*b* of the claw 136 apart. The pawl and notch latch mechanism 128 is thereby placed in a latched configuration, with the a pawl 152 holding the first and second claw portions 136*a*, 136*b* of the claw 36 apart, and holding the hair retaining clip 120 in a generally open configuration, as depicted in FIG. 6. When the first and second handle portions 132, 134 are again squeezed together, while pushing the button 148, the pawl and notch latch mechanism 128 releases and the hair retaining clip 120 is placed in a generally closed configuration, as depicted in FIGS. 4, 5, and 7. If desired, more than one notch 154 may be provided on the surface of the hub 142, and/or a series of saw tooth-shaped ratchet surfaces may be provided on the hub 142, e.g., in order to provide multiple open positions in which the hair retaining clip 120 may be latched.

Figure 9:
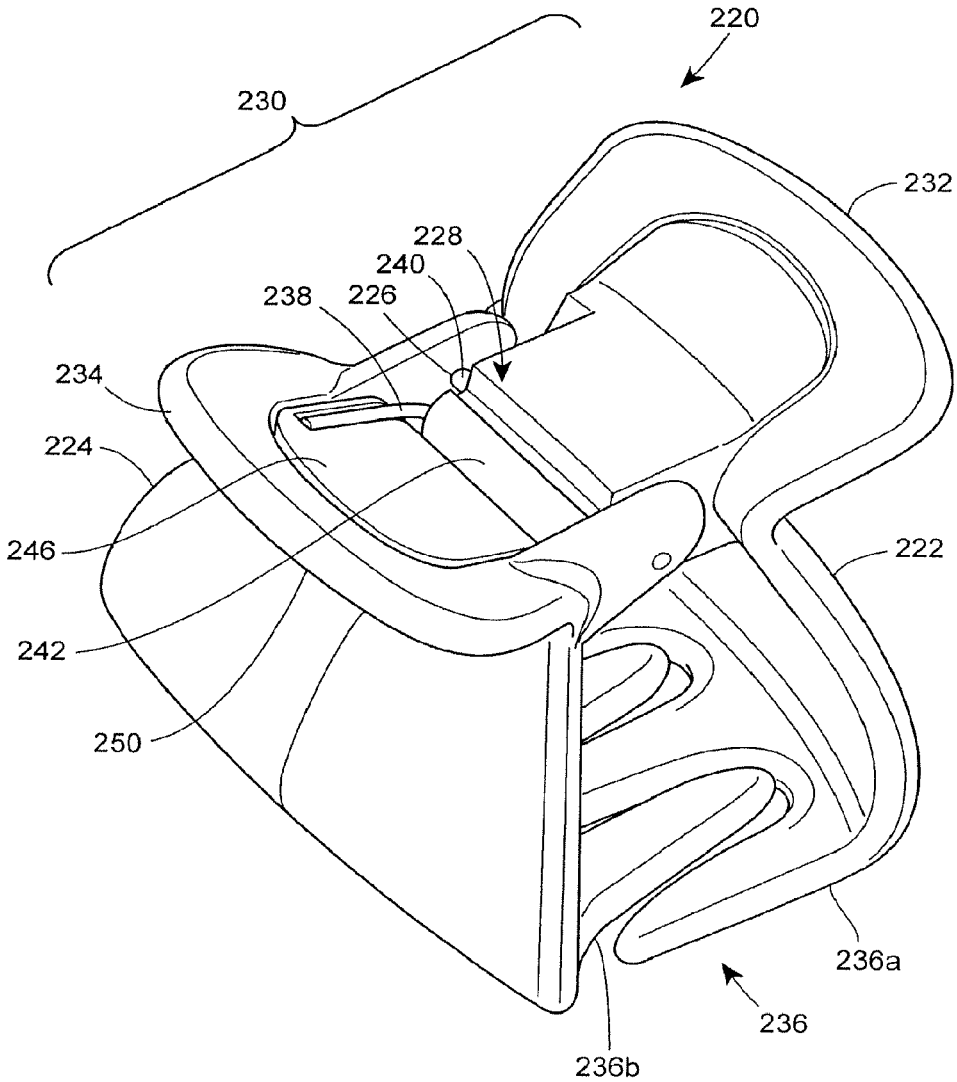
FIG. 9 is a perspective diagrammatic view of another embodiment of a hair retaining clip, in a generally closed configuration.
Figure 10:
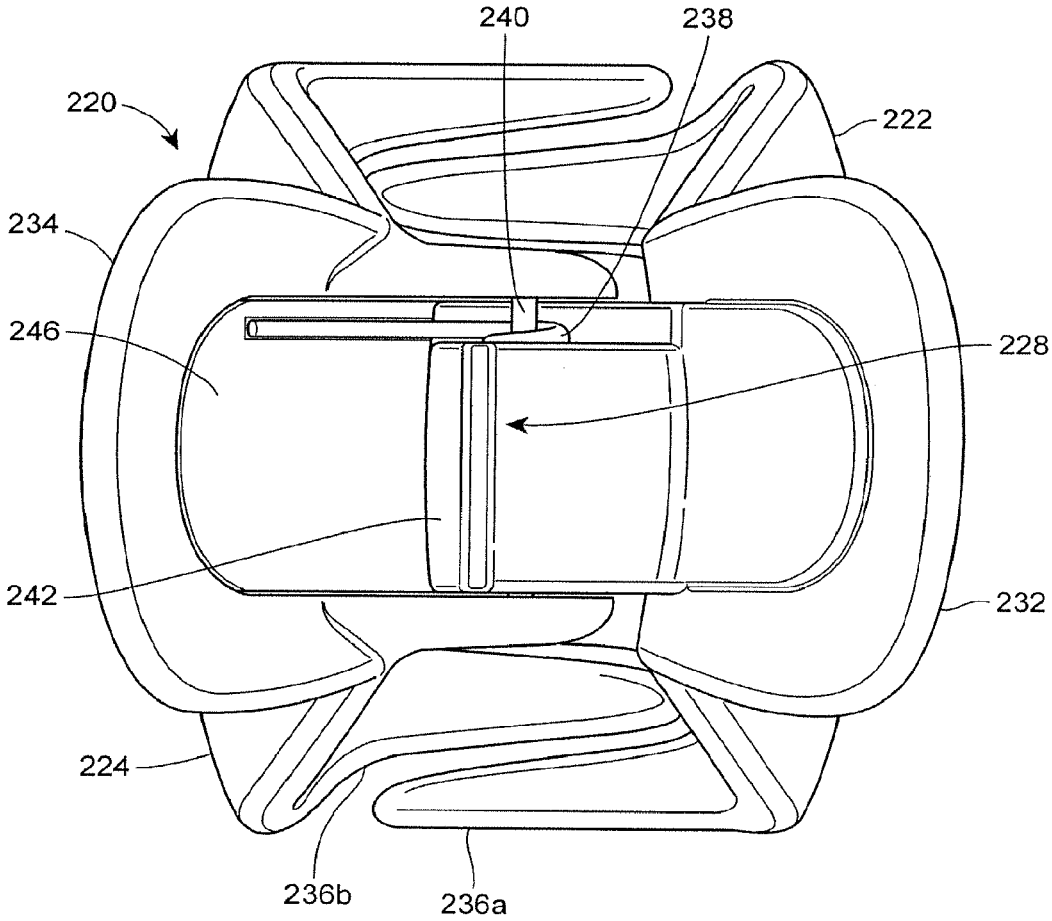
FIG. 10 is a plan diagrammatic view of the hair retaining clip of FIG. 9.
Figure 11:
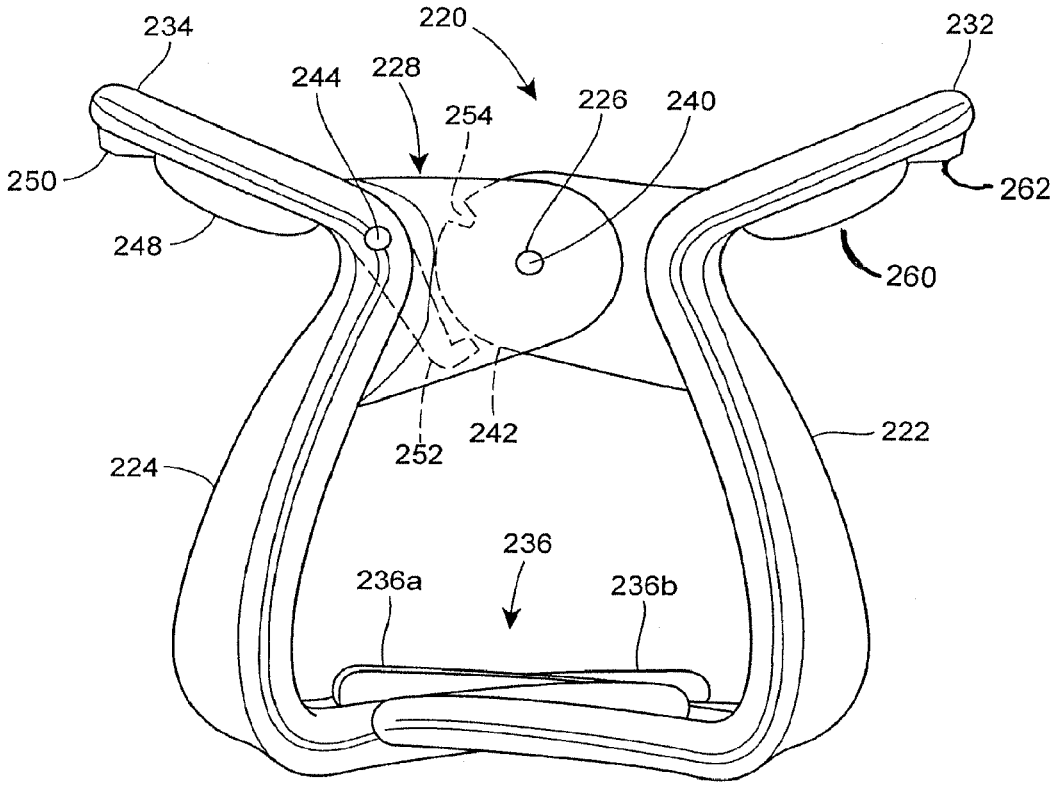
FIG. 11 is a side diagrammatic view of the hair retaining clip of FIG. 9.

FIGS. 9 through 11 depict yet another embodiment, substantially similar to that of FIGS. 4 through 8, in which a hair retaining clip is generally indicated at 220. The hair retaining clip 220 in this exemplary embodiment includes a first half or first clip member 222, a second half or second clip member 224, a hinge 226, and a pawl and notch latch mechanism 228. The first and second clip members 222, 224 are pivotally connected via the hinge 226 near a handle 230 of the hair retaining clip 220. The handle 230 includes a first handle portion 232 that is part of the first clip member 222, and a second handle portion 234 that is part of the second clip member 224. A claw or retaining portion 236 is disposed opposite the handle 230 on the hair retaining clip 220. The claw 236 includes a first claw portion 236*a* that is part of the first clip member 222 and a second claw portion 236*b* that is part of the second clip member 224.

A coil spring 238 may be mounted to the hair retaining clip to provide a bias torque at the hinge 226 that tends to urge the claw 236 toward a closed configuration, as depicted in FIGS. 9 through 11. The coil spring 238 may be mounted such that it surrounds a primary hinge pin 240 and is substantially surrounded by a hub 242.

The pawl and notch latch mechanism 228 may include a pawl hinge pin 244 that pivotally mounts a pawl lever portion 246 to the second handle portion 234. A button 248 may be mounted to the pawl lever portion 246 (or integrally molded as part of the pawl lever portion 246) to facilitate a tactile identification of the pawl lever portion 246 by a user. Thus, when the button 248 is pressed by the user, the pawl lever portion 246 may be rotated in a clockwise direction with respect to the second handle portion 234, as oriented in FIG. 11.

A sculpted ridge 250 may be provided on the second handle portion 234 to provide a tactile identifying cue to the user for avoiding contact with the pawl lever portion 246. By pressing the button 248, while squeezing the first handle portion 232 and the second handle portion 234 toward one another, the user may bring a pawl 252 out of contact with the hub 242, against the force applied to the pawl lever portion 246 by the coil spring 238. This may be done, for example, when the user does not desire the pawl and notch mechanism 228 to engage (i.e., when the user desires to close the hair retaining clip 220 or to avoid having the hair retaining clip 220 latched in an open configuration).

The hair retaining clip 220 may be latched in an open configuration when the pawl 252 engages a notch 254 on the hub 242, and differs from the hair retaining clip 120 of FIGS. 4 through 8 primarily in its aesthetic appearance. For example, the hair retaining clip 220 may include surface features such as a "dummy" button 260 and a further sculpted ridge 262, both disposed on the first handle portion 232, in order to give the hair retaining clip 220 a symmetric appearance. However, the operation of the hair retaining clip 220 may be identical to that of the hair retaining clip 120 of FIGS. 4 through 8, as described in detail above in connection with those figures.

Figure 12:
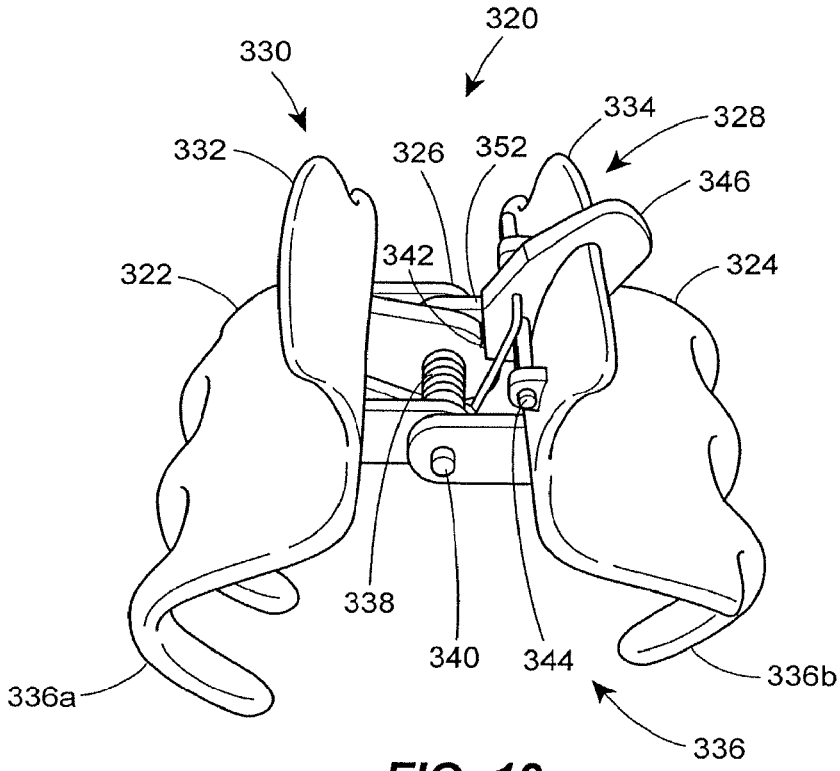
FIG. 12 is a perspective diagrammatic view of yet another embodiment of a hair retaining clip, in a generally open configuration.
Figure 13:
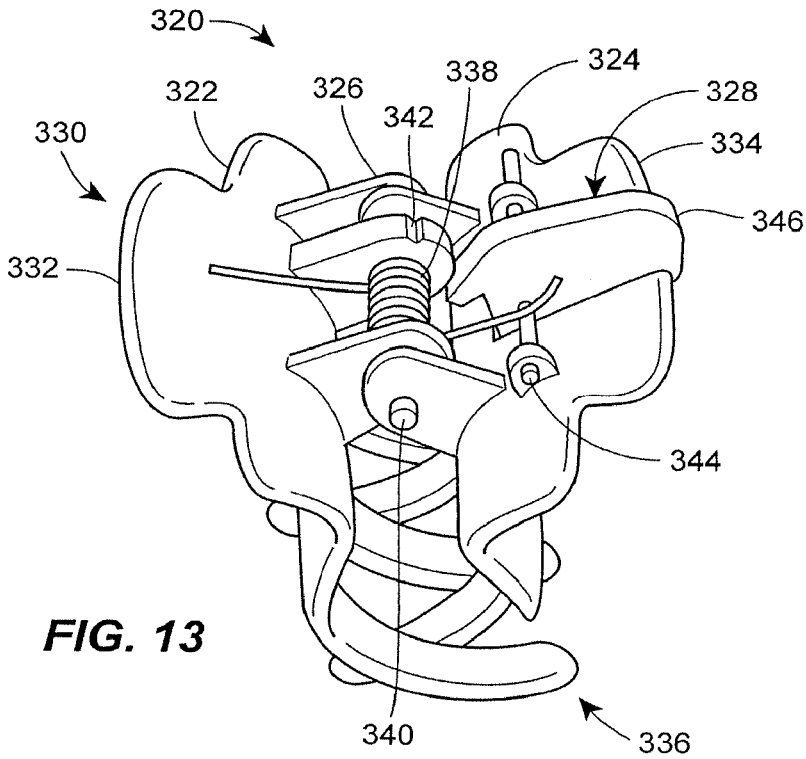
FIG. 13 is a perspective diagrammatic view of the hair retaining clip of FIG. 12, showing the hair retaining clip in a generally closed configuration.

FIGS. 12 and 13 depict yet another embodiment, which is also substantially similar to that of FIGS. 4 through 8, in which a hair retaining clip is generally indicated at 320. The hair retaining clip 320 in this exemplary embodiment includes a first half or first clip member 322, a second half or second clip member 324, a hinge 326, and a pawl and notch latch mechanism 328. The first and second clip members 322, 324 are pivotally connected via the hinge 326 near a handle 330 of the hair retaining clip 320. The handle 330 includes a first handle portion 332 that is part of the first clip member 322, and a second handle portion 334 that is part of the second clip member 324. A claw or retaining portion 336 is disposed opposite the handle 330 on the hair retaining clip 320. The claw 336 includes a first claw portion 336*a* that is part of the first clip member 322 and a second claw portion 336*b* that is part of the second clip member 324.

A coil spring 338 may be mounted to the hair retaining clip to provide a bias torque at the hinge 326 that tends to urge the claw 336 toward a closed configuration, as depicted in FIG. 13. The coil spring 338 may be mounted such that it surrounds a primary hinge pin 340.

The pawl and notch latch mechanism 328 may include a pawl hinge pin 344 that pivotally mounts a pawl lever portion 346 to the second handle portion 334. The pawl lever portion 346 may be mounted in a center portion of the second handle portion 334 to facilitate a tactile identification of the pawl lever portion 346 by a user. Thus, when the pawl lever portion 346 is pressed by the user, the pawl lever portion 346 may be rotated in a counter-clockwise direction with respect to the second handle portion 334, as oriented in FIGS. 12 and 13.

By pressing the pawl lever portion 346, while squeezing the first handle portion 332 and the second handle portion 334 toward one another, the user may bring a pawl 352 out of contact with a notch 342 that rotates with the first handle portion 332, against the force applied to the pawl lever portion 346 by the coil spring 338. This may be done, for example, when the user does not desire the pawl and notch latch mechanism 328 to engage (i.e., when the user desires to close the hair retaining clip 320 or to avoid having the hair retaining clip 320 latched in an open configuration).

By using two fingers on the second handle portion 234 (straddling and not contacting the pawl lever portion 346) and contacting the first handle portion 132 with a thumb to squeeze the first handle portion 334 and the second handle portion 134 toward one another, the user may place the hair retaining clip 320 in an open and latched configuration, as shown in FIG. 12. As in the embodiments of FIGS. 4 through 8 and 9 through 11, the coil spring 338 provides two functions. First, the coil spring 338 urges the handle portions 332 and 334 away from each other, thereby tending to urge the hair retaining clip 320 toward a closed configuration. Second, the coil spring 338 urges the pawl 352 toward the center of the primary hinge 326, thereby ensuring that the pawl 352 will securely engage the notch 342.

Thus, the hair retaining clip 320 may be opened or placed in an open configuration, as seen in FIG. 12, by manually squeezing the first and second handle portions 332, 334 towards each other, thereby moving the first and second claw portions 336*a* and 336*b* of the claw 336 apart. The pawl and notch latch mechanism 328 is thereby placed in a latched configuration, with the a pawl 352 holding the first and second claw portions 336*a*, 336*b* of the claw 336 apart, and holding the hair retaining clip 320 in a generally open configuration, as depicted in FIG. 12. When the first and second handle portions 332, 334 are again squeezed together, while pushing the pawl lever portion 346, the pawl and notch latch mechanism 328 releases and the hair retaining clip 320 is placed in a generally closed configuration, as depicted in FIG. 13. If desired, more than one notch 342 may be provided, and/or a series of saw tooth-shaped ratchet surfaces may be provided, e.g., in order to provide multiple open positions in which the hair retaining clip 320 may be latched.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A hair retaining clip comprising:

a first clip member including a handle portion and a claw portion;

a second clip member including a handle portion and a claw portion;

a hinge pivotally connecting the first and second clip members and including a laterally extending hub portion including a hub notch formed in a surface thereof;

a spring element surrounded by the hub portion and biasing the first and second claw portions toward a generally closed configuration; and a latch mechanism associated with the first and second clip members, the latch mechanism including a pawl lever that is pivotally mounted to the second clip member and adjacent the hub portion, wherein the first and second claw portions can pivot to a generally open configuration, wherein the pawl lever engages the hub notch to retain the first and second claw portions in the generally open configuration, and is spring-biased into engagement with the hub notch to retain the first and second claw portions in the generally open configuration, wherein at least a portion of the pawl lever is substantially coplanar with the second handle portion of the second clip member when the first and second claw portions are in the generally open configuration, wherein, with the first and second claw portions retained in the generally open configuration, depressing the pawl lever pivots it from engagement with the hub notch so that the first and second claw portions are then pivoted under the influence of the spring element to the generally closed configuration, and wherein, when the first and second claw portions are moved from the generally closed configuration toward the generally open configuration, the pawl lever is pivotally spring-biased into engagement with the hub notch to retain the first and second claw portions in the generally open configuration.

2. The hair retaining clip of claim 1, wherein the second portion includes a sculpted ridge for providing tactile identification of a portion of the second handle portion that can be used by a user to open the hair retaining clip without disengaging the latch mechanism.

3. The hair retaining clip of claim 2, wherein the pawl lever includes a button portion that is adjacent the sculpted ridge of the second handle portion when the first and second claw portions are in the generally open configuration.

4. The hair retaining clip of claim 3, wherein the button portion is on an opposite end of the pawl lever from a portion of the lever that engages the hub portion in the generally closed configuration.

5. The hair retaining clip of claim 1, wherein the latch mechanism includes a tab that extends from the pawl lever and that engages the hub notch to retain the first and second claw portions in the generally open configuration.

6. A hair retaining clip for retaining a bundle of hair, the hair retaining clip comprising:

a first clip member having a first end including a handle portion and a second end including a claw portion;

a second clip member having a first end including a handle portion and a second end including a claw portion;

a hinge disposed between and pivotally connecting the first and second clip members and including a laterally extending hub portion;

a spring element surrounded by the hub portion and biasing the first and second claw portions toward a generally closed configuration; and a latch mechanism that may be engaged to retain the first and second claw portions in a generally open configuration, wherein the latch mechanism includes a pawl lever that is pivotally mounted to the second clip member and a hub notch that is formed in a surface of the hub portion, and wherein the pawl lever engages the hub notch to retain the first and second claw portions in the generally open configuration.

7. The hair retaining clip of claim 6, wherein at least a portion of the pawl lever is substantially coplanar with the second handle portion of the second clip member when the first and second claw portions are in generally open configuration.

8. The hair retaining clip of claim 6, wherein the second handle portion includes a sculpted ridge for providing tactile identification of a portion of the second handle portion that can be used by a user to open the hair retaining clip without disengaging the latch mechanism.

9. The hair retaining clip of claim 8, wherein the pawl lever includes a button portion that is adjacent the sculpted ridge of the second handle portion when the first and second claw portions are in the generally open configuration.

10. The hair retaining clip of claim 9, wherein the button portion is on an opposite end of the pawl lever from a portion of the lever that engages the hub notch in the generally closed configuration.

11. The hair retaining clip of claim 6, wherein the latch mechanism includes a tab that extends from the pawl lever and that engages the hub notch to retain the first and second claw portions in the generally open configuration.

12. The hair retaining clip of claim 6, wherein with the first and second claw portions retained in the generally open configuration, depressing the pawl lever pivots it from engagement with the hub notch so that the first and second claw portions are then pivoted under the influence of the spring element to the generally closed configuration.

13. The hair retaining clip of claim 6, wherein the pawl lever is pivotally mounted at an intermediate portion thereof to the second clip member adjacent the hinge.

14. The hair retaining clip of claim 6, wherein the handle portion of the second clip member is laterally loop-shaped and extends from the hinge adjacent end of the spring element, and the pawl lever is nested within the loop-shaped handle portion of the second clip member.

15. The hair retaining clip of claim 6, wherein the pawl lever is spring-biased into engagement with the hub portion by the spring element.

* * * * *